US008117786B1

(12) United States Patent
Tobbe

(10) Patent No.: US 8,117,786 B1
(45) Date of Patent: Feb. 21, 2012

(54) INSULATION BARRIER FOR CEILING HATCH OPENINGS

(76) Inventor: Norbert Tobbe, Chagrin Falls, OH (US)

( * ) Notice: Subject to any disclaimer, the term of this patent is extended or adjusted under 35 U.S.C. 154(b) by 0 days.

(21) Appl. No.: 13/165,669

(22) Filed: Jun. 21, 2011

Related U.S. Application Data

(60) Provisional application No. 61/373,542, filed on Aug. 13, 2010.

(51) Int. Cl.
*E04F 19/08* (2006.01)
*E04B 7/18* (2006.01)

(52) U.S. Cl. ..... 52/19; 52/39; 52/220.8; 52/404.4; 52/407.3; 52/64; 52/646

(58) Field of Classification Search ..... 52/39, 220.1, 52/220.8, 302.1, 19, 202, 404.3, 404.4, 404.5, 52/407.3, 407.4, 646, 64
See application file for complete search history.

(56) References Cited

U.S. PATENT DOCUMENTS

| | | | | | |
|---|---|---|---|---|---|
| 4,281,743 | A * | 8/1981 | Fuller | ..... | 182/46 |
| 4,299,059 | A * | 11/1981 | Smith | ..... | 49/401 |
| 4,312,423 | A * | 1/1982 | Helbig | ..... | 182/46 |
| 4,658,555 | A * | 4/1987 | Steiner | ..... | 52/202 |
| 4,832,153 | A * | 5/1989 | Daw et al. | ..... | 182/46 |
| 4,928,441 | A * | 5/1990 | Daley | ..... | 52/19 |
| 4,944,126 | A * | 7/1990 | King | ..... | 52/202 |
| 5,094,054 | A * | 3/1992 | Arends | ..... | 52/95 |
| 5,271,198 | A * | 12/1993 | Freeman | ..... | 52/202 |
| 5,475,955 | A * | 12/1995 | Dickinson | ..... | 52/202 |
| 5,481,833 | A * | 1/1996 | Williams | ..... | 52/19 |
| 5,623,795 | A * | 4/1997 | Padgett, Jr. | ..... | 52/202 |
| 5,628,151 | A * | 5/1997 | Monat | ..... | 52/19 |
| 6,014,841 | A * | 1/2000 | McCoy et al. | ..... | 52/19 |
| RE36,975 | E * | 12/2000 | Williams | ..... | 52/19 |
| 6,308,480 | B1 * | 10/2001 | Haney | ..... | 52/302.6 |
| 6,578,327 | B1 * | 6/2003 | Hackbarth et al. | ..... | 52/202 |
| 6,701,676 | B1 * | 3/2004 | Kompelien | ..... | 52/19 |
| 7,836,638 | B2 * | 11/2010 | Ogieglo | ..... | 52/19 |
| 2011/0067325 | A1 * | 3/2011 | Modica et al. | ..... | 52/173.1 |

* cited by examiner

*Primary Examiner* — Robert Canfield
*Assistant Examiner* — Babajide Demuren
(74) *Attorney, Agent, or Firm* — Pradip K. Sahu

(57) ABSTRACT

A barrier or dam to contain loose insulation from falling through an attic access hatch or scuttle opening is provided. Embodiments include four pieces that can be assembled together around the perimeter of hatches of varying sizes. Two of the pieces may be male pieces and two may be female pieces. Each piece may have a securing tab on its bottom end to attach each piece to joists that define the hatch opening. A kit comprising the barrier pieces may be utilized by home-owners, contractors or insulation installers for quick and easy installation of the containment dam.

3 Claims, 4 Drawing Sheets

INSULATION BARRIER FOR CEILING HATCH OPENINGS

CLAIM FOR PRIORITY

This application claims priority from U.S. Provisional Patent Application No. 61/373,542 filed on Aug. 13, 2010.

BACKGROUND OF THE INVENTION

In residential and commercial building structures, it is common practice to insulate ceilings by blowing loose cellulose material into the attic space so that it covers the ceiling from above. The loose cellulose insulation is normally blown in to a height of ten to sixteen inches, which exceeds the height of the four or six inch ceiling joists. Since attics have hatches, scuttles or pull-down stair or ladder openings of various sizes to gain access to the attic, the additional loose insulating material would fall through the openings unless contained by a barrier or dam.

To overcome this problem, cardboard dams have been cut to size and stapled to the hatch opening on the outside of the frame. This is the least expensive dam but is very flimsy and the four corners of the hatch opening are not secure. There is also a void space around the entire two inch by four inch or two inch by six inch frame that is not covered by insulation. This results in heat escaping.

Custom-built wood or plywood dams have also been used on top of the frame of the openings to raise the height and form a barrier dam for the insulating material. However, this method to fabricate and install the wood dam is time-consuming and, therefore, costly. There are a number of other hatch dam products sold on the market that will contain or dam the insulating material, but these are made from steel or plastic materials that are only available in specific sizes and are quite costly. As a result, they are not particularly favorable since hatches may come in many sizes.

SUMMARY OF THE INVENTION

In an embodiment, a four piece panel kit for quick and easy assembly to contain or dam the loose insulation around the hatch opening is provided. Two of the panels may be designated as male panels and the other two may be designated as female panels. All panels are generally in ninety degree angular form, such as squares or rectangles. Securing tabs are integrated into each panel for attaching to the outside of the hatch frame. The four panels are positioned on top of corresponding four corners of the hatch frame with the tabs down. The male panels slide into the female panels to provide a containment dam. The size of the dam can be adjusted because the panels slide one into the other to readily accommodate variable joist spacing in different building constructions. The four panels can be secured to the outside frame of the hatch opening by stapling, screwing or nailing the tabs attached to each of the four panels. The materials used for the panels can be made of cardboard or plastic or any other materials to conform with applicable fire codes.

One principal advantage of embodiments of the present invention is to provide an improved means for containing or damning the loose insulation around a hatch opening by using a four panel kit that can be installed in less time than other containment dams now available. Another advantage of the four panel kit is that it is adjustable and will fit most hatch openings. Another advantage is that the four panel kit sits on top of the existing two inch by four inch or two inch by six inch wood hatch frame, providing insulation value. This would eliminate an insulation void that appears when using some of the existing hatch containment dams on the market.

Another advantage of embodiments of the invention is that the prefabricated hatch dam would not be flimsy—it would be much sturdier. It could easily support the weight of a two hundred pound person standing on the panels after installation. Another advantage is the four panel kit would be a less expensive containment dam than those sold on the market, especially since the material used to make the prefabricated hatch dam could be made from recycled cardboard or plastic.

Insulation installers can bring the prefabricated hatch dams with them. It can be installed in the same amount of time by stapling or nailing the tabs to the outside of the hatch frame as the improvised cardboard dams that are presently being used.

DRAWINGS

DETAILED DESCRIPTION

Figure 1:
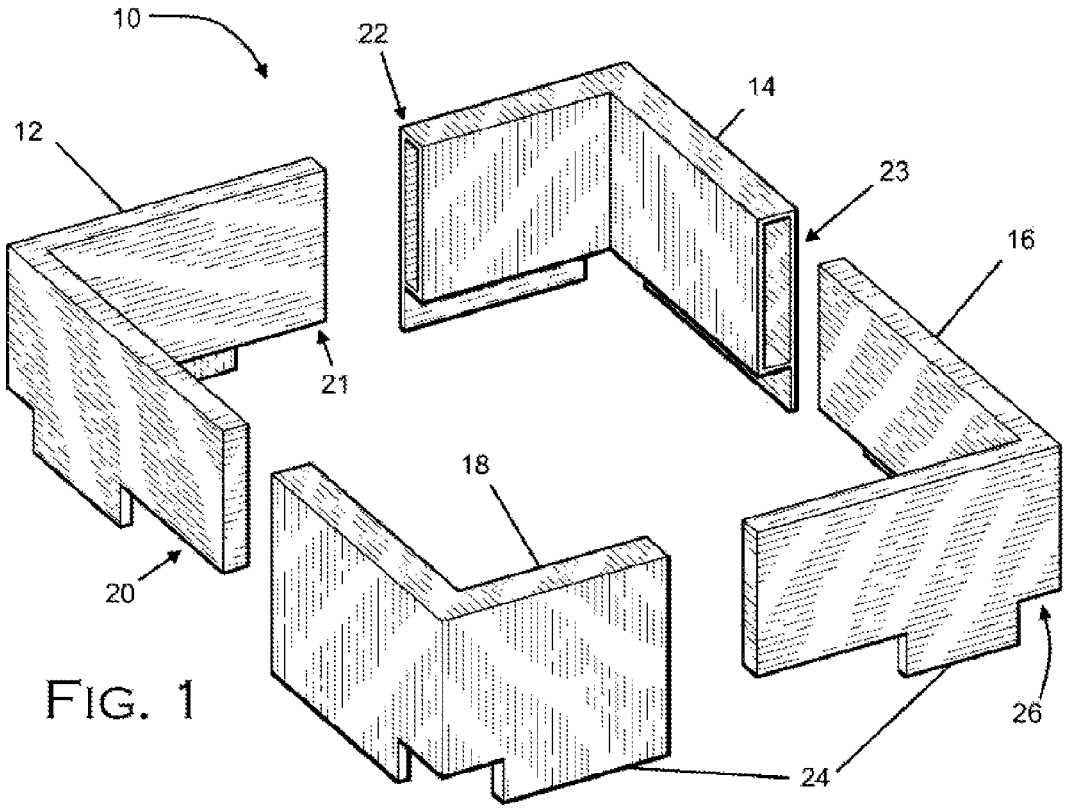
FIG. 1 is a top perspective, exploded view of an embodiment of the dam.

Referring now to FIG. 1, an exploded view of an embodiment of the insulation dam is depicted generally at 10. The dam 10 comprises four main parts 12, 14, 16 and 18. Two of these parts are male pieces 12, 16 and two are female pieces 14, 18. The male pieces 12, 16 have inserting ends 20, 21 on the ends that slidably engage with the female pieces. The female pieces 14, 18 have receiving ends 22, 23. In preferred embodiments, the male pieces 12, 16 have sufficient length to allow an installer to slide the male pieces 12, 16 within the female pieces 14, 18 to accommodate different sizes of ceiling hatch openings.

Figure 2:
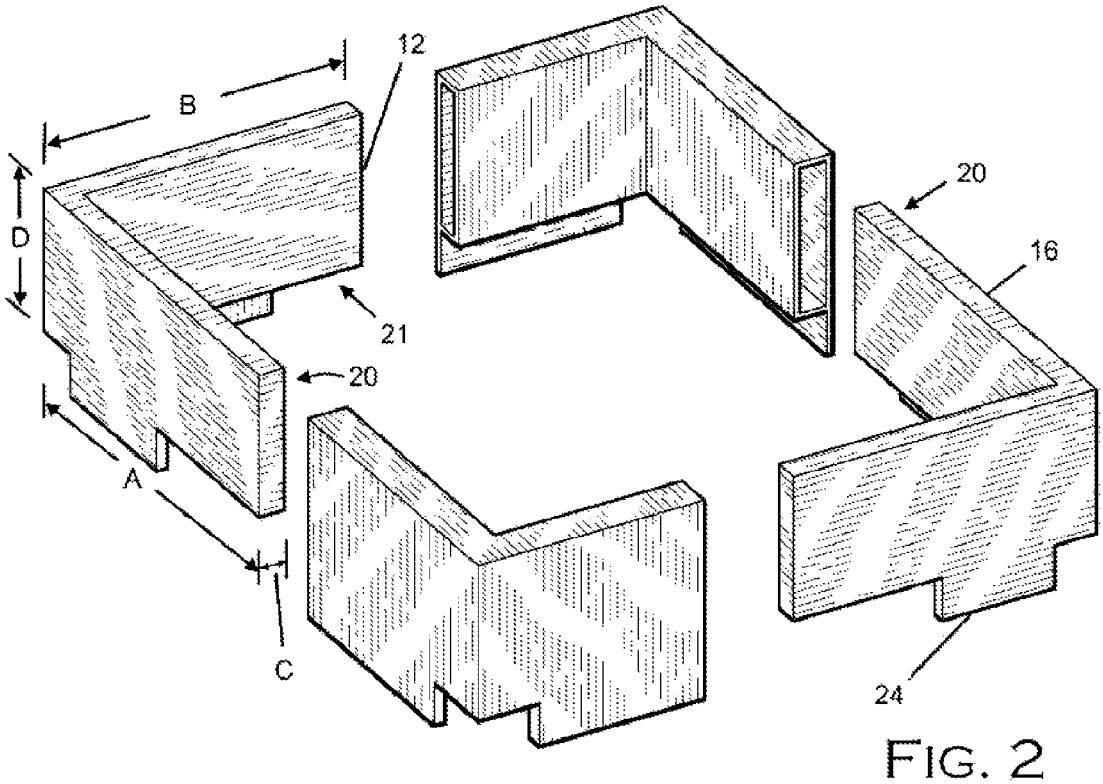
FIGS. 2 through 5 are the top perspective, exploded view shown in FIG. 1 in which certain dimensions of the components are labeled.
Figure 3:
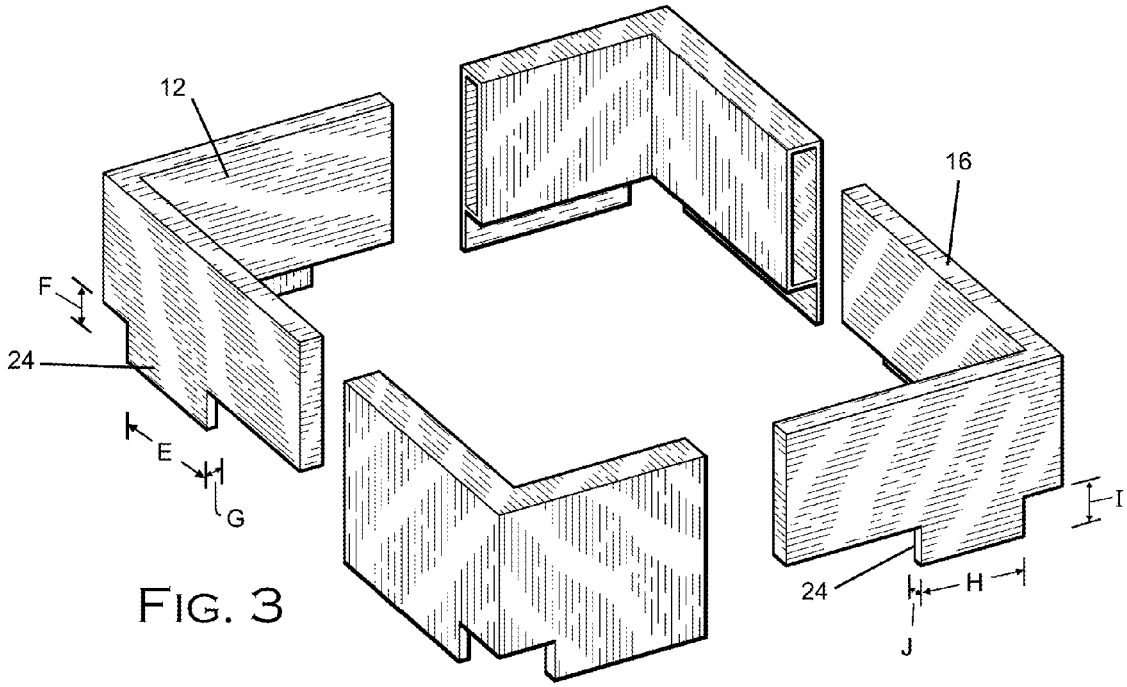

Now referring to FIGS. 2 and 3, and by way of example only, a male piece 12 can have one inserting end 20 with a length A of about eighteen inches and the other inserting end 21 with a length B of about sixteen and one half inches. The male pieces 12, 16 are preferably solid with a width C of about one and three eighths inches. The height D of the male piece 12, 16 may be about fifteen and three quarters inches. The securing tab 24 on one side of the male piece 12, 16 can have a length E of about ten inches, height F of about three inches and thickness G of about one fourth of an inch. The securing tab 24 on the other side of the male piece 12, 16 can have a length H of about eleven inches, height I of about three inches and thickness J of about one fourth of an inch. Each of these securing tabs 24 may be positioned on the dam 10 so that one side of the tab 24 is two inches away from the corner of the dam 10.

Figure 4:
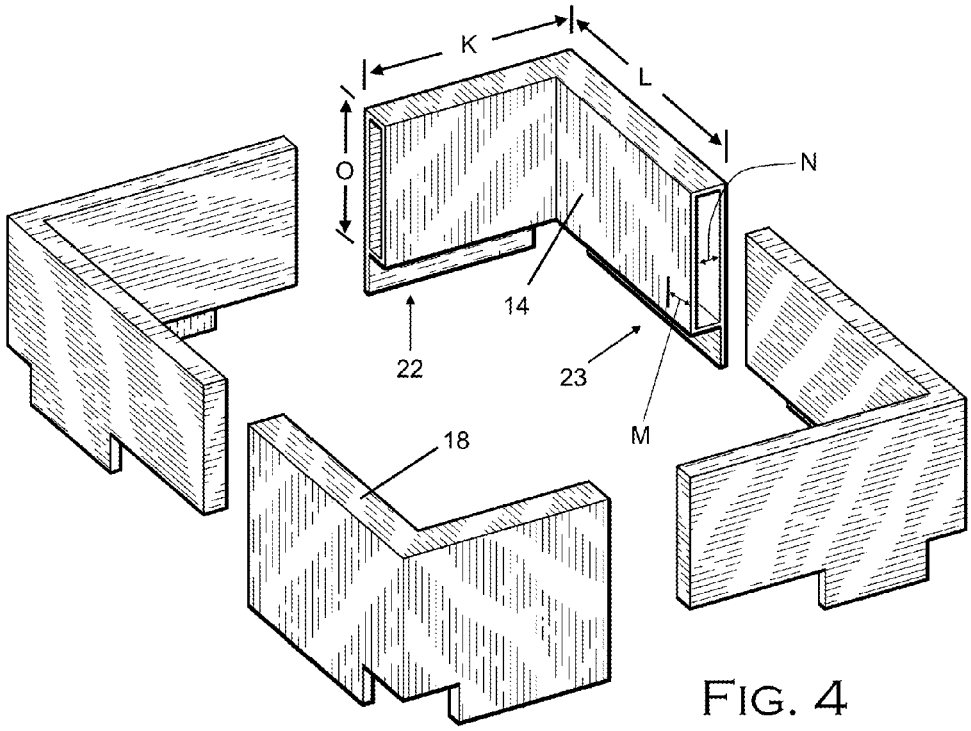
Figure 5:
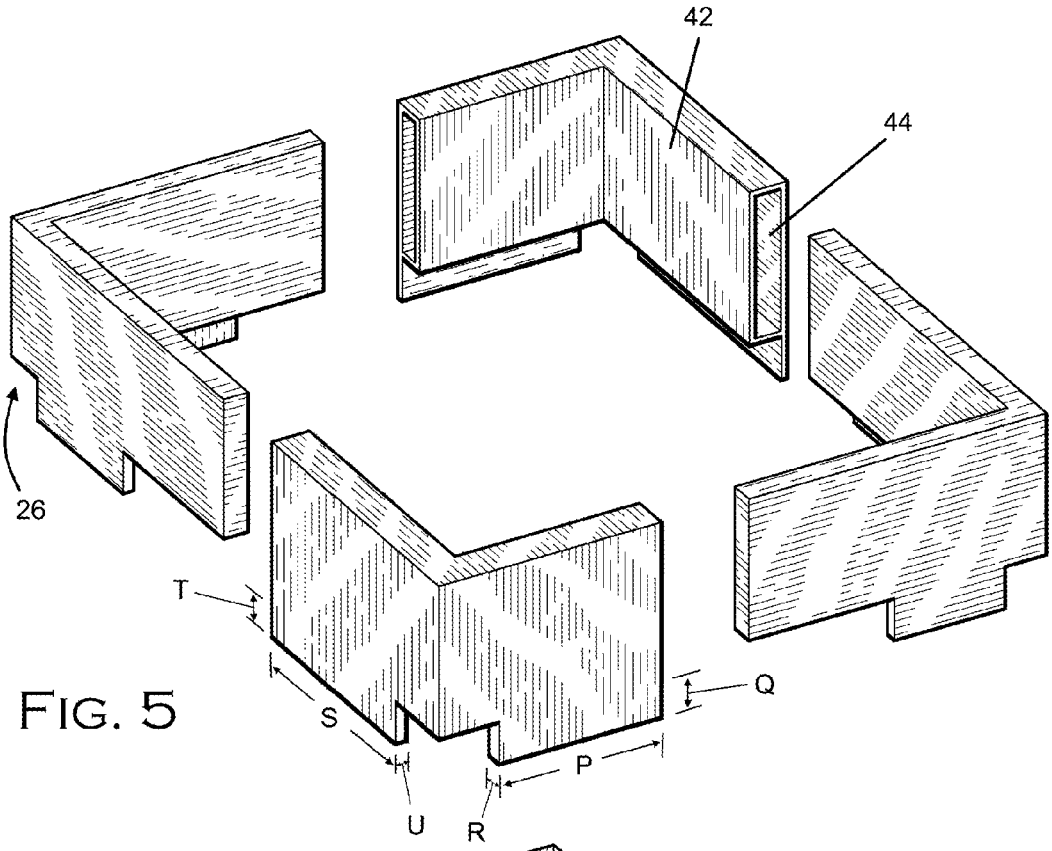
Figure 6:
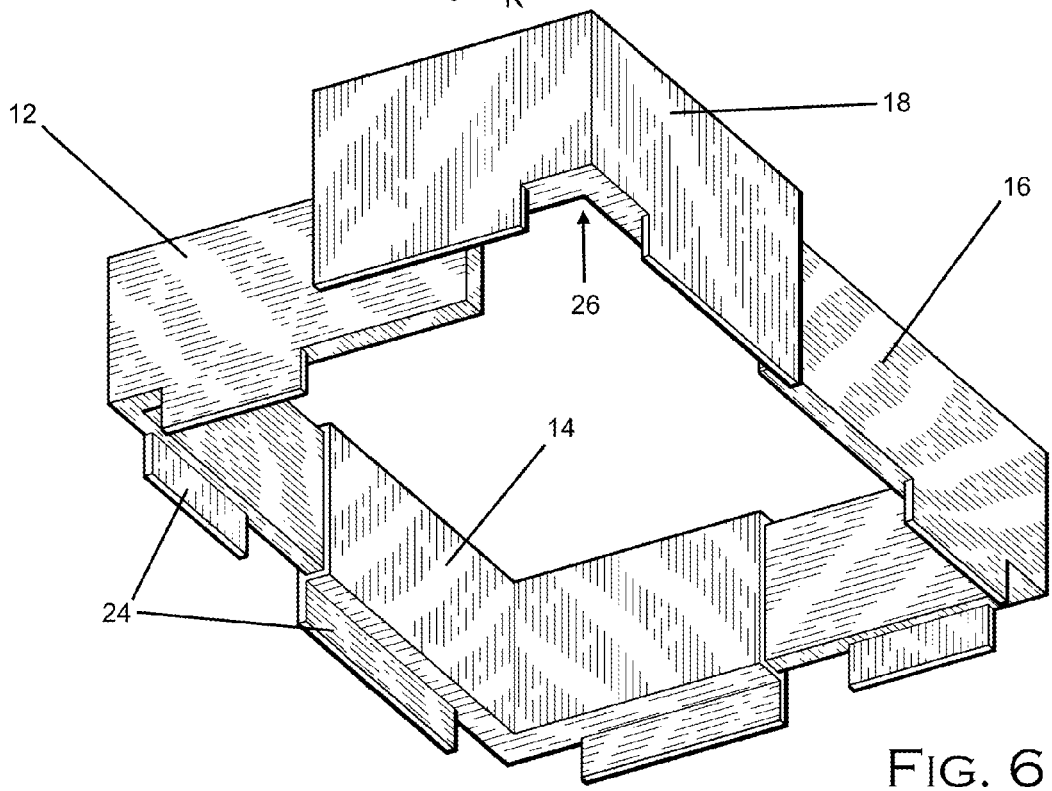
FIG. 6 is a bottom perspective, partially exploded view of the dam shown in FIG. 1.

With reference to FIGS. 4 and 5, and by way of example only, a female piece 14, 18 can have one receiving end 22 with a length K of about thirteen inches and the other receiving end 23 with a length L of about eighteen inches. The female pieces 14, 18 can be made to be solid in its main body 42 and have recesses 44 in the ends in which the inserting ends 20, 21 of the male pieces 12, 16 can slide. The recesses 44 may have a depth M of about three and one half inches. The recesses 44 may have a width N of about one and three eighths inches, which corresponds to the width C of the male pieces 12, 16. The female pieces 14, 18 may have a height O of about sixteen inches, which corresponds to the height D of the male pieces 12, 16. The securing tab 24 on one side of the female piece 14, 18 can have a length P of about ten and one half inches, height Q of about three inches and thickness R of about one fourth of an inch. The securing tab 24 on the other side of the female piece 14, 18 can have a length S of about sixteen inches, height T of about three inches and thickness U of about one fourth of an inch. Each of these securing tabs 24 may be positioned on the dam 10 so that one side of the tab 24 is two inches away from the corner of the dam 10.

Moreover, each piece may have securing tabs 24 located on their bottom portions. The securing tabs 24 may be integral with each piece, as shown in the figures. In addition, the securing tabs 24 of each piece may be constructed and arranged to define saddles 26. These saddles 26 allow the dam 10 to more securely rest upon joists or beams that form the framework for a ceiling.

Referring now to FIG. 5, a partially exploded, bottom perspective view of an embodiment of the dam 10 is depicted in which three pieces 12, 14, 16 of the dam 10 are assembled and one female piece 18 is offset from the assembly. This view better shows the inside portions of the securing tabs 24.

Figure 7:
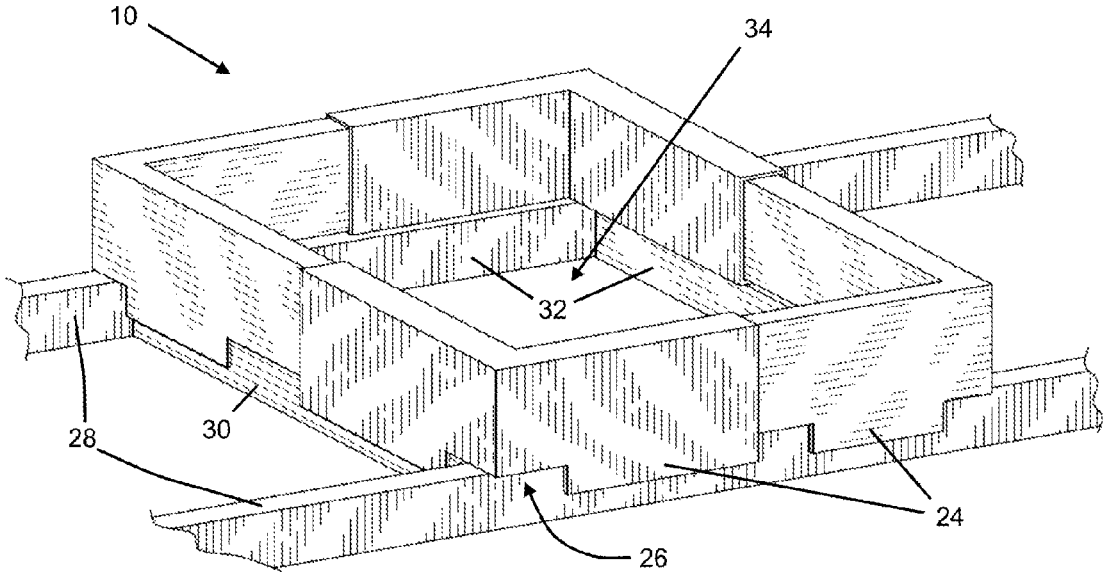
FIG. 7 is a top perspective view of an embodiment of the dam installed around a ceiling hatch.
Figure 8:
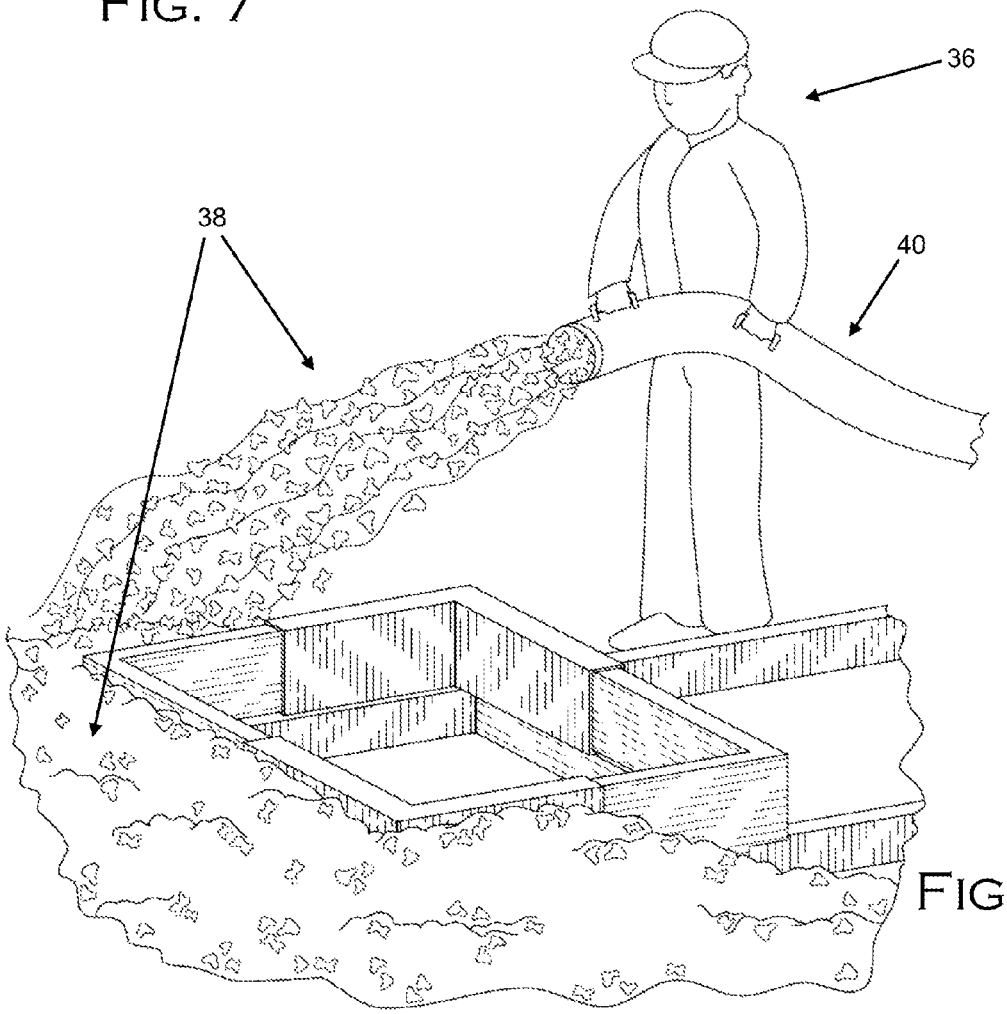
FIG. 8 is a top perspective view of the dam with an insulation installer blowing insulation over the ceiling and around the dam.

Referring now to FIGS. 7 and 8, a fully assembled dam 10 is depicted in one of the environments in which it is intended to be used. The ceiling joists 28, 30 form a hatch frame 32 upon which the dam 10 rests. The hatch frame 32 defines the hatch opening 34. These figures help to illustrate how the saddles 26 rest upon the joists, and they help to visualize the tabs 24 as they rest against the sides of the joists 28, 30. These tabs 24 are preferable secured to the joists 28, 30 using staples, nails, screws, brads, tape, fasteners or other affixing means known in the art. Once the dam 10 is affixed around the ceiling hatch frame 32, an insulation installer 36 may blow insulation 38 using a hose 40 all around the attic, for example, while the dam 10 prevents the insulation 38 from falling through the hatch opening 34.

While particular embodiments of the present insulation dam have been described herein, it will be appreciated by those skilled in the art that changes and modifications may be made thereto without departing from the invention in its broader aspects and as set forth in the following claims.

I claim:

1. An insulation dam for ceiling hatch openings comprising:

four generally rectangular panels wherein two of the four panels are male panels and two of the four panels are female panels, the four panels each having integrated securing tabs that extend vertically downward from bottoms of the four panels; wherein the dam can have its size adjusted by an installer; the male panels having inserting ends that are to be inserted into and enclosed by receiving ends of the female panels; and the securing tabs on each panel constructed and arranged to be separated at a distance from corners on the panels so that they create a saddle on each panel.

2. A kit comprising the insulation dam of claim 1 and an affixing means.

3. The kit of claim 2 wherein the affixing means is selected from the group consisting of staples, nails, screws, brads, fasteners, adhesives and tape.

* * * * *